US008276991B2

(12) United States Patent
Thomson

(10) Patent No.: US 8,276,991 B2
(45) Date of Patent: Oct. 2, 2012

(54) GUIDE SHOE FOR A ROLLER-TYPE LOADER AND WEAR INSERTS FOR GUIDE SHOES

(75) Inventor: John Thomson, Lanarkshire (GB)

(73) Assignee: Caterpillar Global Mining Europe GmbH, Lünen (DE)

( * ) Notice: Subject to any disclaimer, the term of this patent is extended or adjusted under 35 U.S.C. 154(b) by 451 days.

(21) Appl. No.: 12/523,876

(22) PCT Filed: Jan. 16, 2008

(86) PCT No.: PCT/EP2008/000286

§ 371 (c)(1),
(2), (4) Date: Jul. 21, 2009

(87) PCT Pub. No.: WO2008/089904

PCT Pub. Date: Jul. 31, 2008

(65) Prior Publication Data

US 2010/0019563 A1 Jan. 28, 2010

(30) Foreign Application Priority Data

Jan. 23, 2007 (DE) ..... 20 2007 001 277 U

(51) Int. Cl.
*E21C 29/02* (2006.01)

(52) U.S. Cl. ..... 299/42

(58) Field of Classification Search ..... 299/34.04, 299/34.1, 34.11, 42, 43, 10, 47
See application file for complete search history.

(56) References Cited

U.S. PATENT DOCUMENTS

| | | | | |
|---|---|---|---|---|
| 4,515,409 | A * | 5/1985 | Parrott | 299/43 |
| 2005/0151412 | A1 * | 7/2005 | Tillessen et al. | 299/34.04 |
| 2005/0161995 | A1 * | 7/2005 | Tillessen et al. | 299/34.1 |

FOREIGN PATENT DOCUMENTS

| | | | |
|---|---|---|---|
| DE | 2504421 | A1 | 8/1975 |
| DE | 2552085 | A1 | 5/1977 |
| DE | 3718442 | C1 | 12/1988 |
| DE | 19712774 | A1 | 2/1998 |
| DE | 19844052 | C1 | 9/2000 |
| DE | 102006032680 | A1 | 1/2008 |

OTHER PUBLICATIONS

International Search Report for PCT/EP2008/000286, Filed Jan. 16, 2008.

English translation of International Preliminary Report on Patentability (Written Opinion of the International Searching Authority) dated Aug. 4, 2009 for PCT/EP2008/00286, filed Jan. 16, 2008.

* cited by examiner

*Primary Examiner* — John Kreck
(74) *Attorney, Agent, or Firm* — Rankin, Hill & Clark LLP

(57) ABSTRACT

A guide shoe for a shearer loader, in particular for a shearer-loader drive assembly, comprising at least one base wall, comprising a guide projection, on the base-wall side, for engaging under a rack drive of a rack drive arrangement, and comprising a guide surface for engaging behind the rack drive. To achieve shorter downtime periods in the case of repairs to the shearer-loader drive assembly due to wear, and in order to reduce their susceptibility to wear, the guide projection and the guide surface are realized on wear inserts that are movably and, preferably, replaceably fastened, or fastenable, to the guide shoe. Movement of the wear inserts could be limited by pivot limiting strips or inhibited by clamping strips.

25 Claims, 6 Drawing Sheets

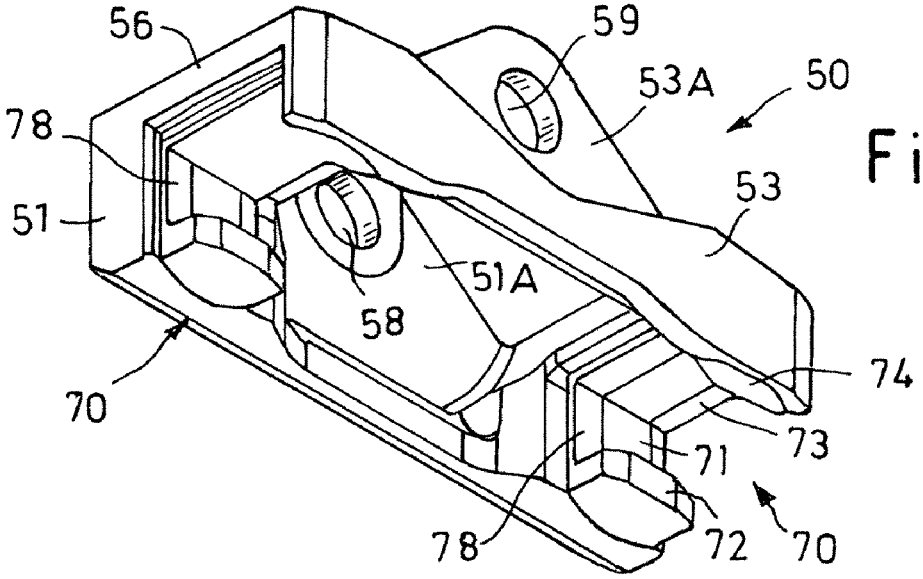
Fig.3
Fig.4
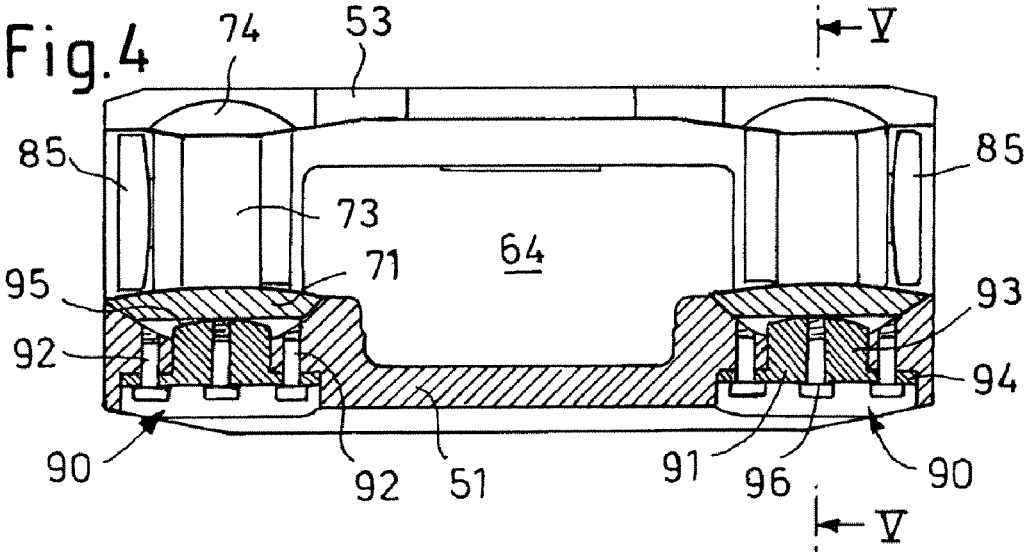
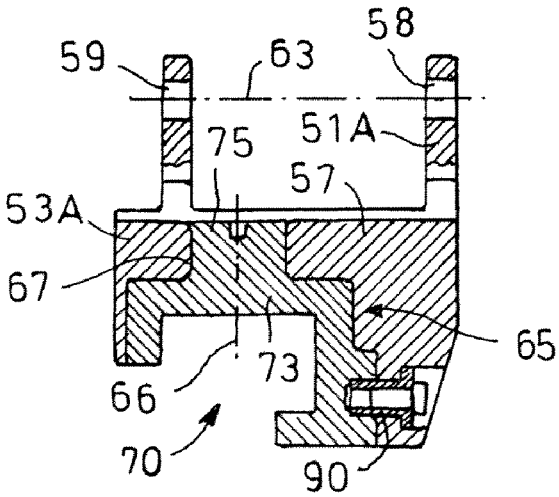
Fig.5

Fig.11
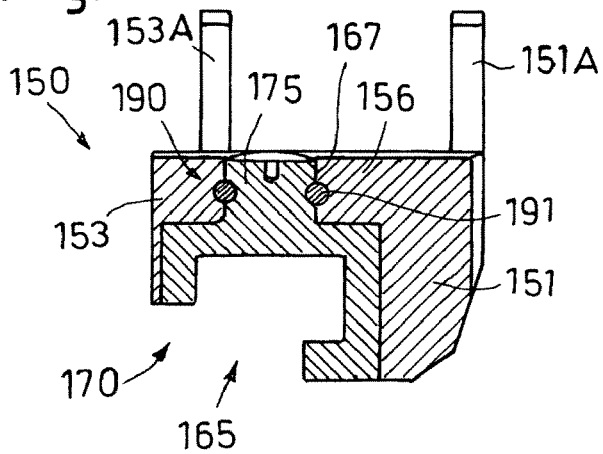
Fig.12
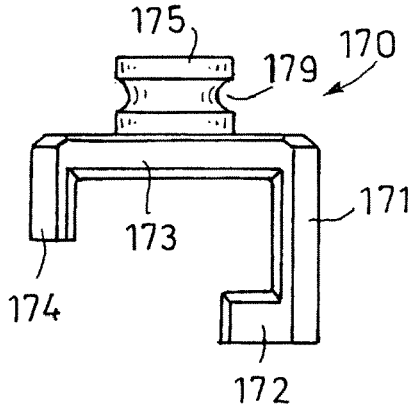
Fig.13
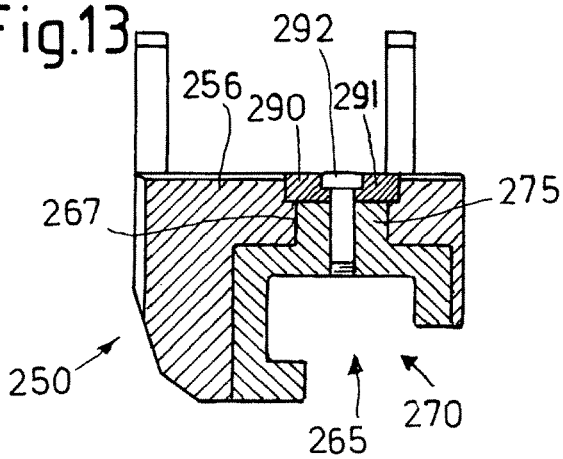
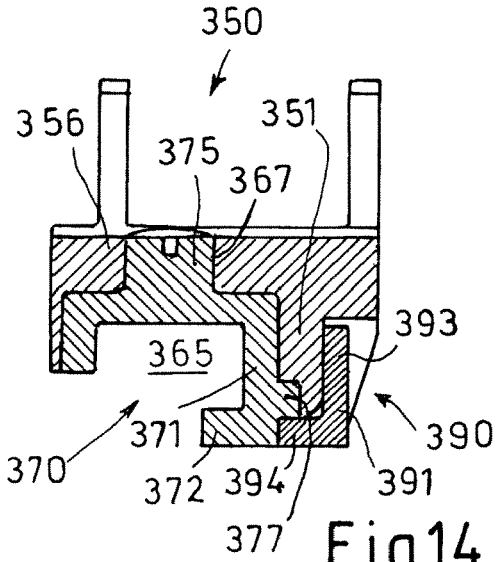
Fig.14
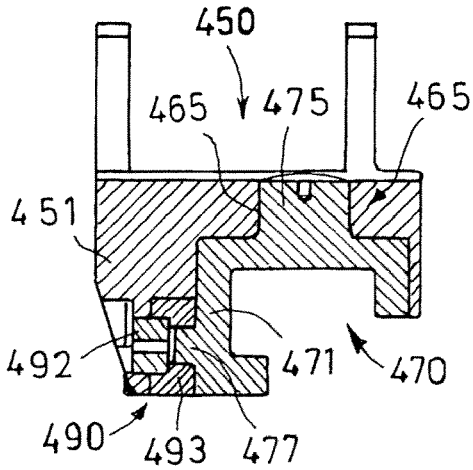
Fig.15

GUIDE SHOE FOR A ROLLER-TYPE LOADER AND WEAR INSERTS FOR GUIDE SHOES

This application claims priority to and the benefit of the filing date of International Application No. PCT/EP2008/000286, filed Jan. 16, 2008, which application claims priority to and the benefit of the filing date of German Application No. 20 2007 001 277.2, filed Jan. 23, 2007, both of which are hereby incorporated by reference into the specification of this application.

The invention relates to a guide shoe for a shearer loader, in particular for a shearer-loader drive assembly, comprising at least one base wall, comprising a guide projection, on the base-wall side, for engaging under a rack drive of a rack drive arrangement, and comprising a guide surface for engaging behind the rack drive. Further, the invention also relates to wear inserts for corresponding guide shoes for shearer loaders or shearer-loader drive assemblies.

BACKGROUND OF THE INVENTION

In underground mining, shearer loaders, which, in extraction operations, are used, in particular, for working coal, are moved along a conveyor that can be advanced in the face working direction and that comprises, in addition to guide rails for the shearer loader, a rack drive, which is usually constituted by toothed racks or a chain and into which racks or chain there engages from above the driving toothed wheel of a drive assembly of the shearer loader, which, by means of its machine body, reaches over the conveyor in the manner of a portal. The shearer loader can then be moved along the rack drive arrangement through motor-actuated driving of the driving toothed wheel. In order to ensure reliable engagement of the toothing of the driving toothed wheel in the rack drive constituted by the chain or the toothed racks, the drive assembly is guided on the rack drive by at least one guide element, or guide shoe. Owing to the great weight of the shearer loader, and owing to lumps of rock or the like, which can clog the rack drive arrangement, the wear, both on the driving toothed wheel of the shearer-loader drive assembly and on the guide shoe, is relatively high, and it is necessary for the guide shoes and/or the driving toothed wheel to be replaced at regular intervals.

In the case of a shearer-loader drive assembly known from DE 197 12 774 A1, the driving toothed wheel is screw-connected to a transmission toothed wheel. The toothed wheel can be demounted, following demounting of a cover that is opposite a housing baseplate of the drive assembly, together with a bearing tube and the bearings for the driving toothed wheel. The guide shoe comprises a specially designed hook projection, which engages both under and behind a lower guide strip of a toothed rack or the like. In the case of this solution, the resource requirement for mounting and refitting is relatively high, since, in the case of repair of the driving toothed wheel, it is necessary to demount a structural unit consisting of a driving toothed wheel, a transmission toothed wheel, bearings and a bearing shaft. The hook projection, which, by means of a V-shaped portion, engages under and behind the guide strip on the rack drive, is replaceably screw-connected to the housing baseplate.

There is known from the older, non-prepublished patent application DE 10 2006 032 680 of the applicant, a guide shoe, which, as a replacement part, can be detached relatively easily from the drive assembly, since, for the purpose of anchoring the guide shoe on the drive assembly, a robust bearing bolt is merely inserted in a bearing axle for the driving toothed wheel. The guide shoe has a base wall and an opposing wall, the bearing bolt engaging through these walls when in the mounted state. The guide shoe can be removed downwards from the drive assembly following demounting of the bearing bolt, while the drive assembly is still fastened to the machine body of the shearer loader. For the purpose of mounting/demounting the guide shoe, it is necessary only to remove a rack-drive bar.

SUMMARY OF THE INVENTION

In accordance with the present invention, provided is a guide shoe for a shearer loader, or shearer-loader drive assembly, which renders possible yet shorter downtime periods in the case of repairs to the shearer-loader drive assembly due to wear, and whose susceptibility to wear due to the design is reduced.

This object and further objects are achieved for a guide shoe according to the invention in that the guide projection and the guide surface are realized on wear inserts that are movably and, preferably, also replaceably fastened, or fastenable, to the guide shoe. Owing to the wear inserts being arranged such that they are movable, the running behavior of the guide projections and guide surfaces on the rack drive can again be improved significantly in comparison with the known solutions. Whereas, in the prior art, it has hitherto been proposed only that the guide shoe itself be arranged such that it is pivotable about a substantially horizontal axis, or axis coinciding with the bearing axis of the driving toothed wheel, on the shearer-loader drive assembly, or the machine body, in the case of the solution according to the invention the movable wear inserts, which include all wear regions such as, in particular, the guide projection and the guide surface, can even better accommodate to an offset course of the rack drive of the rack drive arrangement, such that even a large distance between two guide shoes, by which a shearer loader is guided on the rack guide, does not result in blockages or binding between the guide shoe and the rack drive arrangement, and thereby in increased wear on the guide regions of the guide shoe. Running behavior and susceptibility to wear are also improved in the region of a guide shoe, however, since the wear inserts can accommodate to offsets between two successive toothed racks of a rack drive. It is particularly advantageous if the movable wear inserts, which include at least the guide projection and the guide surface, and therefore the partial surfaces subjected to the greatest wear on the guide shoe, are replaceable, since this renders possible a situation whereby, preferably, only these "wear surfaces" need be produced from a material, in particular a more wear-resistant material, that differs from that of the remaining regions of the guide shoe. In addition, in the case of servicing or repair, it is necessary to replace only the wear inserts, while otherwise the guide shoe can remain in its mounted position. The downtime period can be significantly reduced by this measure alone. The combination of replaceable and movable wear inserts on the guide shoe constitutes the, in particular, preferred development according to the invention. Owing to the wear inserts being replaceably arranged on the guide shoes, the overall production and servicing costs for the guide shoes can be reduced, since, on the one hand, there are lesser demands on the material for the guide shoes and, on the other hand, in the case of a replacement, only the wear inserts actually subjected to the greater wear are replaced.

In one embodiment, the guide shoe comprises, in addition to the base wall having the guide projection, on the base-wall side, for engaging under a rack drive arrangement, an opposing wall, which is opposite and rigidly connected to the base wall, and on the side of which there is arranged the guide surface for engaging behind the rack drive arrangement, there preferably being realized, in the base wall and the opposing wall, passage openings for the engagement and passage of a bearing bolt, for the purpose of pivotably mounting and supporting the guide shoe on the shearer-loader drive assembly.

It is advantageous if the wear inserts are accommodated in the guide shoe such that they can be removed downwards, such that, in the case of a service interval, the replacement of the wear inserts can be performed, not only in the region of the face/roadway transition, but also, in principle, at any position along the face or the rack drive. Here, likewise, it again suffices for a rack-drive bar of the rack drive arrangement to be briefly demounted, in order for the wear inserts then to be removed downwards.

According to another aspect, the wear inserts that are inserted in the receivers are pivotable about a pivot axis, the pivot axis preferably being aligned perpendicularly relative to the axis of the bearing bolt by means of which, in the case of the, in particular, preferred development, the guide shoe is pivotably mounted and supported on the shearer-loader drive assembly. Since each guide shoe has a length of, for example, approximately one meter, and therefore a length corresponding approximately to a half to one third of a rack-gear bar, it is particularly advantageous if each guide shoe has two receivers, spaced apart from one another, for respectively one wear insert, such that two movable wear inserts, spaced apart from one another, can be accommodated in each guide shoe. The distance between the two movable wear inserts can then still be approximately 65% to 85% of the total length of the guide shoe. Expediently, the receivers for the wear inserts are realized on both sides of the passage openings, in order to render possible running of the guide shoe, and therefore of the shearer loader on the rack drive arrangement, that is as uniform as possible and, in addition, in order for both wear inserts to be loaded in a substantially uniform manner, according to the direction of travel of the shearer loader.

According to yet another aspect of the invention, the wear inserts are realized on a back side, preferably a back side that faces upwards in the mounted state, having a pivot pin, which, advantageously, is realized as an integral component part of the wear insert and can be inserted in a bearing receiver for the pivot pin, which bearing receiver is realized as a component part of the receiver. Owing to the realization of a pivot pin on the wear inserts, the mobility of the wear inserts in the guide shoes when in the mounted state can be achieved relatively easily. It is advantageous if the base wall and the opposing wall of the guide shoe are connected to one another via two transverse webs that are spaced apart from one another, each transverse web having a bearing receiver for the pivot pin of a wear insert. Secure, pivotable support of the wear insert can be achieved by means of a relatively robustly realized pivot pin and a correspondingly matched bearing receiver in the transverse web.

According to a further aspect, each wear insert has four limbs arranged at right angles to one another, it being the case, respectively, that the one outer limb constitutes the guide projection and the other outer limb constitutes the guide surface. There is thereby imparted to the wear insert an overall approximately J-shaped cross-section, the pivot pin preferably being realized on one of the inner limbs, preferably on the inner limb directly adjoining the outer limb that comprises the guide surface. In order additionally to reduce the wear on the wear inserts, it is particularly advantageous if the insides of the limbs of the wear insert are hardened, in particular, flame-hardened, or provided with a plated-on or welded-on wear layer.

In order to improve the pivoting mobility of the wear inserts in the receivers of the guide shoe, the back wall of the limb on the base-wall side and the back side of the limb on the opposing-wall side are preferably curved in a circular arc. Expediently, the receivers for the wear inserts then comprise a trough-shaped hollow in the base wall and a trough-shaped hollow in the opposing wall, which hollows are realized concentrically relative to the pivot axis, in order for the wear inserts to be securely supported in the receivers and in order to allow only swiveling as a degree of freedom, in addition to replacement, or removal, in the downward direction. According to a preferred development, pivot limiting means can be assigned to the wear inserts, which pivot limiting means preferably restrict the maximum pivoting movement of each wear insert to $<10°$, preferably $\leqq 6°$. According to another embodiment, pivot limiting strips can be arranged in both receivers, these strips, advantageously, being welded to the underside of the transverse webs. In order that, by means of the pivot limiting strips, only a limited swiveling of the wear inserts is allowed, the pivot limiting strips can have, on one side, two wedge surfaces that diverge from one another in a wedge shape and, in the mounted state, constitute bearing contact surfaces for the end faces of the wear inserts, either the one wedge surface or the other wedge surface constituting the stop, depending on the swiveling.

To enable the wear inserts to be removed and replaced by other wear inserts in a particularly simple manner, each wear insert should be replaceably fastened in the receiver by means of an appropriate securing means. According to an embodiment alternative, the securing means can act positively in combination with the pivot pin, the pivot pin preferably having for this purpose, on the circumference, a circumferential groove in which the securing means engages in a positive manner. The securing means can then be constituted, for example, by two U-shaped clips, by a screw or by two screws, which, by means of their shank or their tip, engage in the groove and thus prevent vertical removal of the wear inserts from the receivers, but at the same time allow a pivoting movement. The securing means could also, at the same time, constitute the pivot limiting means.

According to yet another embodiment, a longitudinal groove is realized in the back wall of the base-wall limb of the wear insert. Expediently realized in the base wall, so as to match the longitudinal groove, there is a recess assigned to each receiver for a wear insert, in which recess a retaining piece, which engages in the longitudinal groove, is inserted or can be inserted as securing means for the wear insert. It is understood that the longitudinal groove is preferably realized in the back side and in the back wall of the corresponding limb of the wear insert that is curved in a circular arc. Here, likewise, the retaining piece could, at the same time, constitute or support the pivot limiting means. Each retaining piece, expediently, can have a baseplate having passage holes for fastening screws, and a locking tongue, which, in the mounted state, engages in the longitudinal groove on the wear insert and applies the locking in the vertical direction, transversely relative to the swiveling direction, but allows swiveling. Screw-in holes, for fastening the retaining piece, can be realized, next to the recess, in the base wall of the guide shoe. Securing of the retaining piece can then be effected by means of robust threaded screws.

Further, it is additionally advantageous if the mutually opposite limbs of the wear insert, in particular those limbs that, in the mounted state, bear on the front side and the back side of the rack drive, are provided with bevels at their edge regions, the angle of the bevel preferably being approximately 10°. The respective bevels can additionally improve the running behavior of the wear inserts, and thereby of the guide shoes, since they can cause the movable wear inserts to be pre-aligned to the alignment of the rack drive.

The aforementioned objects are also achieved, in particular, by wear inserts for guide shoes for shearer loaders or shearer-loader drive assemblies that are characterized in that they have a pivot pin, by means of which they can be inserted in a replaceable manner and, in the mounted state, such that they are movable, in particular pivotable about a vertical pivot axis, in a bearing receiver on the guide shoe. The wear inserts according to the invention can be realized as described in detail above.

According to a further alternative development, the mobility of the wear inserts can undergo inhibition, or be inhibited, preferably only temporarily or under certain conditions of use or operation. Arrestment of the wear inserts can be effected through locking by means of securing means, by means of inserts, or by fastening of intermediate pieces. The arrestment of the pivoting mobility can also be achieved through modification of the securing means, in that there are used securing means that not only restrain the wear inserts in a replaceable manner in the receiver, but also inhibit the pivoting mobility at the same time. Further, alternatively, clamping strips, e.g. instead of the pivot limiting strips, can also be used for inhibiting the pivoting mobility, in particular welded or detachably screwed onto the underside of the transverse webs, which clamping strips preferably inhibit the pivoting mobility through positive bearing contact on the wear inserts.

The above object can therefore also be achieved in the case of a guide shoe for a shearer loader, in particular for a shearer-loader drive assembly, comprising at least one base wall, comprising a base-wall guide projection for engaging under a rack drive of a rack drive arrangement, and comprising a guide surface for engaging behind the rack drive, in that the guide projection and the guide surface are realized on wear inserts that are replaceably fastened, or fastenable, to the guide shoe, but without there being any pivoting mobility, or the pivoting mobility being arrested or inhibited.

These and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 3 shows a perspective view of a guide shoe according to the invention, having two built-in, movable wear inserts;

FIG. 4 shows a partially opened view of the underside of the guide shoe in FIG. 3;

FIG. 5 shows a sectional view along V-V in FIG. 4;

FIG. 11 shows a sectional view along XI-XI in FIG. 10;

FIG. 12 shows a side view of the wear insert used in the case of the guide shoe according to FIG. 10;

FIG. 13 shows a third exemplary embodiment for a guide shoe, in a vertical section through one of the bearing receivers for the wear insert;

FIG. 14 shows a fourth exemplary embodiment for a guide shoe according to the invention, in a vertical section through the bearing receiver for a wear insert;

FIG. 15 shows a fifth exemplary embodiment for a guide shoe according to the invention, in a vertical section through a bearing receiver for a wear insert;

DETAILED DESCRIPTION OF EMBODIMENTS

Figure 1:
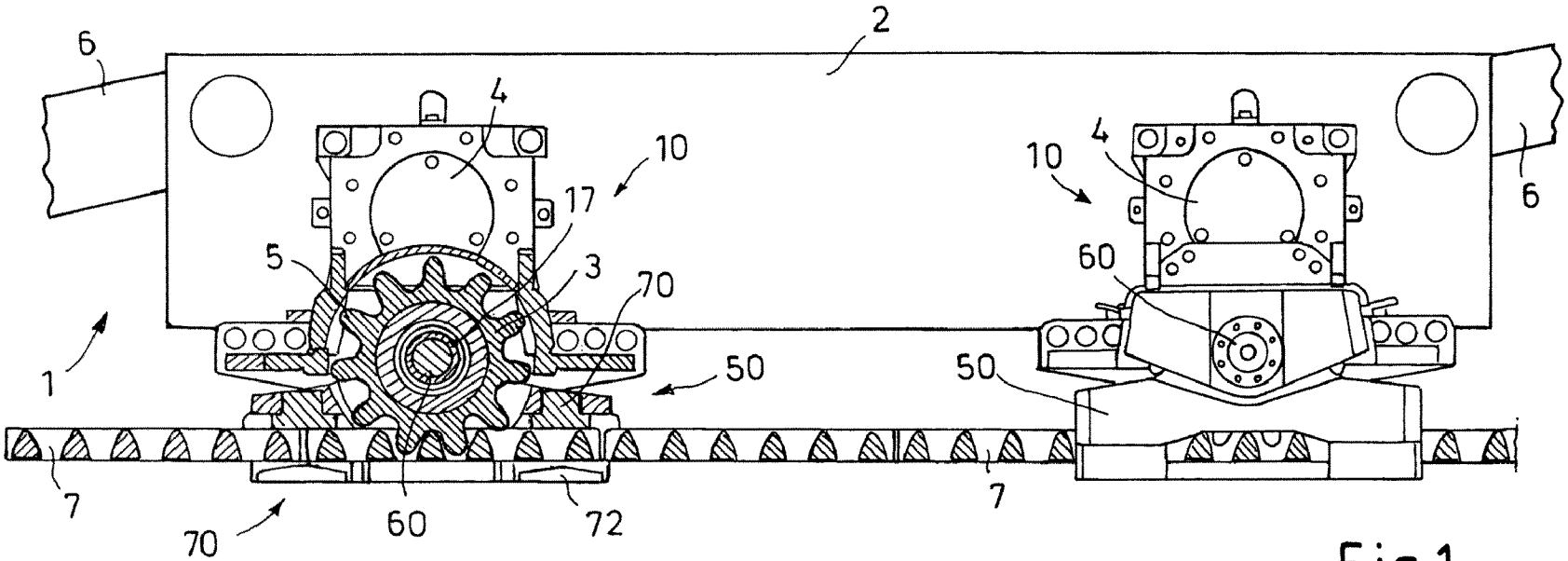
FIG. 1 shows a schematic side view of a shearer loader having two shearer-loader drive assemblies guided on a rack drive by means of guide shoes according to the invention.

Referring now to the drawings wherein the showings are for the purpose of illustrating preferred and alternative embodiments of the invention only and not for the purpose of limiting same, FIG. 1 shows, schematically simplified, a shearer loader 1, whose shearer loader body 2 reaches over a face conveyor, not represented, in the manner of a portal. Fastened to the shearer loader body 2 in an articulated manner, for both directions of travel of the shearer loader 1, are pivot arms 6, on which are mounted the rotatable cutter drums, not represented, which are equipped with working tools (not represented). For the purpose of moving the shearer loader 1 in both possible directions of travel along the longitudinal extent of the face conveyor, two shearer-loader drive assemblies 10 are fastened to the shearer loader body 2 in such a manner that, if necessary, they can be demounted as complete drive assemblies. The shearer-loader drive assemblies 10 each have a transmission 4 having an output-side toothed wheel, by means of which the drive energy of a drive motor, not represented, is transmitted to the driving toothed wheels 3 of both drive assemblies 10. In order that the shearer loader 1 can move parallelwise relative to the face conveyor by means of the drive assemblies 10, a rack drive arrangement is normally mounted on the backfill side of the face conveyor, which rack drive arrangement comprises, as a rack drive, a multiplicity of serially arranged toothed racks 7, the spaces of which are so designed that the teeth 5 of the driving toothed wheel 3 can engage in the spaces from above, in order to achieve movement of the shearer loader 1 through meshing of the driving toothed wheel 3 with the toothed racks 7. Since the basic structure of a shearer loader, having drive assemblies, and having toothed wheels that engage in appropriate toothed racks or rack drive arrangements, is known to one skilled in the art, no further description is given here of the shearer loader or of the face conveyor with corresponding gully lengths and connected rack drive arrangements.

The present invention relates, rather, to the structure and the design of guide shoes 50, by means of which the drive assembly 10 is guided on the toothed racks 7, on the backfill side, in such a way that it can always be ensured that the teeth 5 of the driving toothed wheels 3 can engage in the spaces in the toothed racks 7, and the teeth of the driving toothed wheel 3 are always prevented from being able to disengage from the corresponding tooth spaces in the toothed rack 7. In the exemplary embodiment shown in FIG. 1, the guide shoes 50 are mounted and supported such that they are pivotable about an axis, on the drive assembly 10, coinciding with the rotational axis of the driving toothed wheels 3. The mounting and support in this case are effected via a bearing bolt 60 that is extended through passage openings on the guide shoes 50 and anchored on both sides, outside of the guide shoe 50, on the drive assembly 10, to enable the guide shoe 50 to be mounted and demounted by, respectively, inserting and removing the bolt 60. For this purpose, the socket bolt or bearing bolt 60 extends through the inner bore of a bearing tube 17, which can be seen in the shearer-loader drive assembly 10 on the left, and on the outer circumference of which the driving toothed wheel 3 is rotatably supported. An exemplary embodiment for an advantageous pivotable mounting of a guide shoe 50 by means of a bearing bolt 60 is described in the older patent application DE 10 2006 032 680 of the applicant, to the disclosure content of which reference is made in connection therewith.

As is to be explained in detail, the guide shoe 50 is supported, in a plurality of zones, on the outer surfaces of the toothed racks 7, or of the rack drive of the rack drive arrangement, in order to ensure reliable guidance of the shearer loader 1 and optimum interaction between the driving toothed wheel 3 and the toothed rack 7. According to the invention, for this purpose provision is made whereby the direct contact surfaces between the guide shoe 50, on the one hand, and the guide regions on the toothed rack 7 constituting the rack drive, on the other hand, are arranged, not directly on the guide shoe 50, but on wear inserts 70, which are replaceably and pivotably accommodated in the guide shoes 50. As can be seen clearly from FIG. 1 alone, the two wear inserts 70, which are spaced apart from one another, and which are arranged, with uniform spacing, next to and beneath the bearing and support location for the guide shoe that is constituted by means of the bearing bolt 60, can be removed downwards from the guide shoes 50. To demount the wear inserts 70 from the guide shoes 50, it suffices for a toothed rack 7 to be removed, or dismounted, on a partial length along the rack drive, before the shearer loader 1 is moved into a position in which one of the two drive assemblies 10 is located exactly above the demounted toothed rack. Since replacement of the wear inserts 70 is effected downwards, corresponding servicing work can be performed substantially at any position in the face, without the necessity of moving the shearer loader 1 into the region of the face/roadway transition. At the same time, it is particularly advantageous that the contact surfaces at which the guide shoe 50 contacts the toothed racks 7 are realized on replaceable wear inserts 70. The wear inserts can therefore, on the one hand, be made from a material that is more wear resistant than that of the guide shoe 50 and, on the other hand, only the wear inserts need be demounted and replaced by new wear inserts, with short downtime periods of the shearer loader, or of the underground excavation equipment. Both the shearer-loader drive assembly 10 and the associated guide shoe 50 remain in their mounted position for this purpose.

Figure 2:
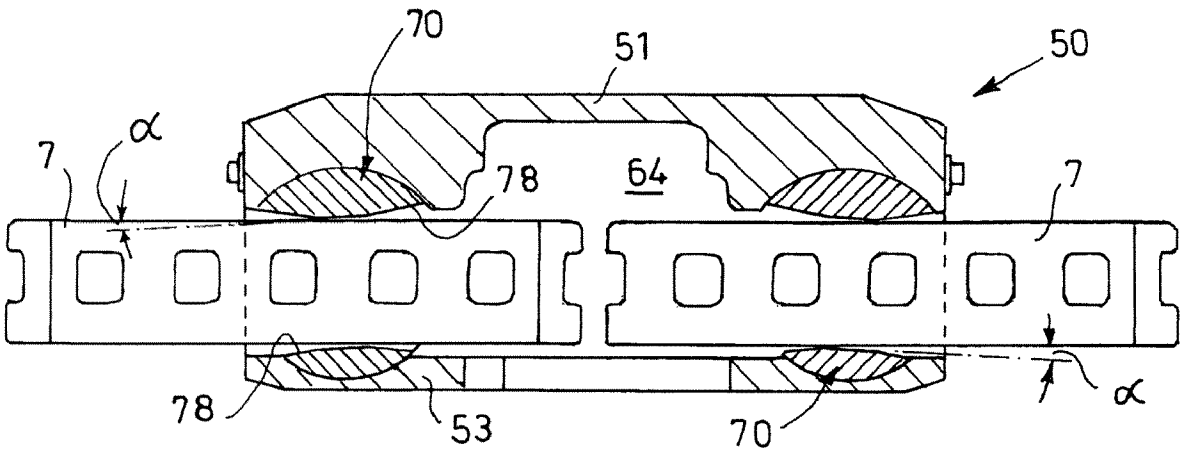
FIG. 2 shows a schematic horizontal section through a guide shoe according to the invention, to illustrate the maximum swiveling capability of the wear inserts.
Figure 6:
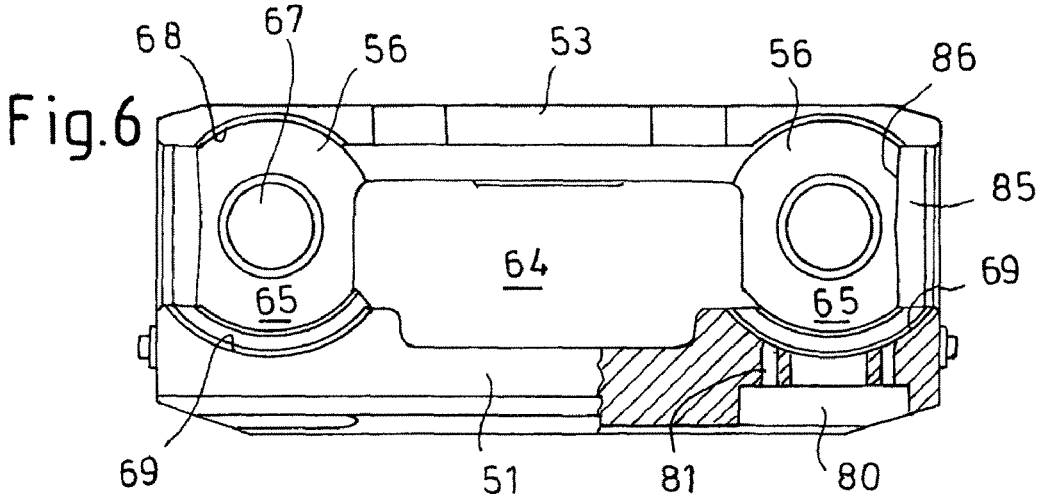
FIG. 6 shows a partially open view of a guide shoe according to FIG. 3, with the wear inserts demounted.

FIG. 2 shows, again schematically, two serially arranged toothed racks 7, with the guide shoe 50 that effects guidance on the toothed racks 7. It can be seen particularly clearly in FIG. 2 that the direct contact between the guide shoe 50 and the toothed racks 7 is located only in the region of the two wear inserts 70. FIG. 2 shows, at the same time, that the two wear inserts 70 can be swiveled, perpendicularly relative to the longitudinal extent of the toothed racks 7, by an angle $\alpha$, both in the one and in the other direction, this angle $\alpha$ preferably being $<5°$, in particular maximally approximately 3°. Since the total length of a guide shoe 50 can be, for example, approximately 1 m, the pivotable arrangement of the wear inserts 70, in particular, enables the guide shoe 50 to accommodate optimally to offsets of the face conveyor, or offsets of the toothed racks 7, including in the region of a transition of a toothed rack 7 to the subsequent toothed rack 7, and consequently enables the wear that can occur, in particular, in the case of the offsets occurring unavoidably between adjacently located gully lengths and toothed racks 7, to be reduced.

Reference is now made to FIGS. 3 to 9, in which a first exemplary embodiment of a guide shoe 50, with replaceable wear inserts 70 movably accommodated therein, is represented in detail. The guide shoe 50, which can be realized as a single-piece casting, but is preferably realized as a composite of a plurality of individual parts welded to one another, has a relatively robustly realized base wall 51 and an opposing wall 53, which is opposite the latter, the base wall 51 and the opposing wall 53 being rigidly connected to one another via robust transverse webs 56. The base wall 51, which, when the guide shoe 50 is in the mounted state, as shown in FIGS. 1 and 2, faces towards the shearer loader 1, or the working face, extends vertically over the entire height of the guide shoe 50 and, in the mounted state, downwards beyond the toothed racks (FIG. 1). Both the base wall 51 and the opposing wall 53 comprise a wall portion 51A and 53A, respectively, which projects upwards, as a bearing limb, over the transverse webs 56, and which has passage openings 58, 59, through which the bolt (60, FIG. 1) for supporting the guide shoe 50 on the shearer-loader drive assembly can be seated. Realized on both lateral edges of the guide shoe 50, between the inner surfaces of the base wall 51, the transverse webs 56 and the opposing wall 53, there are receivers 65, in which the wear inserts 70 are accommodated such that they are pivotable about a pivot axis 66 aligned perpendicularly relative to the bearing axis 63 for the fastening bolt 60 (FIG. 1). Both the receivers 65 in the guide shoes 50 and the other surfaces of the base wall 51 and of the opposing wall 53 are realized and arranged in such a way that, in the operating state, i.e., in particular, during movement of the shearer loader, they cannot come into contact with the toothed racks of the rack drive arrangement. Instead, the wear inserts 70 have a total of four limbs, namely, two inner limbs 71, 73 and two outer limbs 72, 74, all of which, when applied in operation, bear on the rack drive arrangement and are offset in relation to one another according to the configuration of the toothed racks, or of the rack drive. In the exemplary embodiment according to FIGS. 3 to 9, the individual limbs 71, 72, 73 and 74 are each at right angles to one another, and the one outer limb 72 constitutes a guide projection that engages under the rack drive, while the other outer limb 74, by means of its inside, constitutes a guide surface that engages behind the toothed racks of the rack drive arrangement. Owing to the engagement under and behind the rack drive, the driving toothed wheel, which, by means of its teeth, engages through the central opening 64 in the guide shoe, can engage reliably, by means of its teeth, in the tooth spaces of the toothed racks.

The pivotable accommodation and mounting of the wear inserts 70 in the receivers 65 in and beneath the transverse webs 56 of the guide shoes 50 is achieved by means of pivot pins 75, which are realized, as integral component parts, on the back side of the, in the mounted position, upper inner limb 73 of the wear inserts 70 and which engage in bearing receivers 67 in the transverse webs 56.

Figure 7:
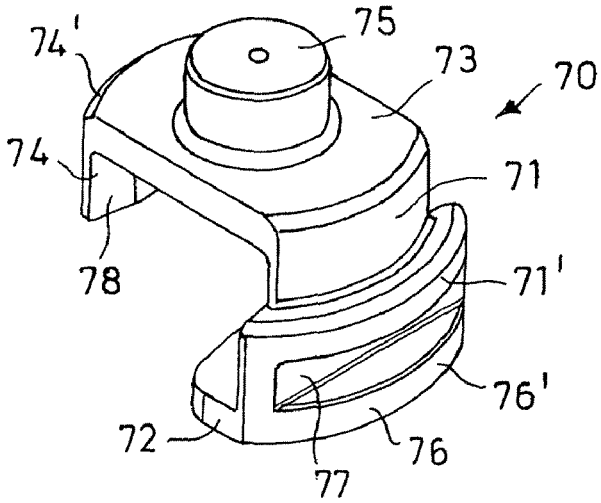
FIG. 7 shows a perspective view of a wear insert that can be inserted in the guide shoe according to FIGS. 3 to 6.
Figure 8:
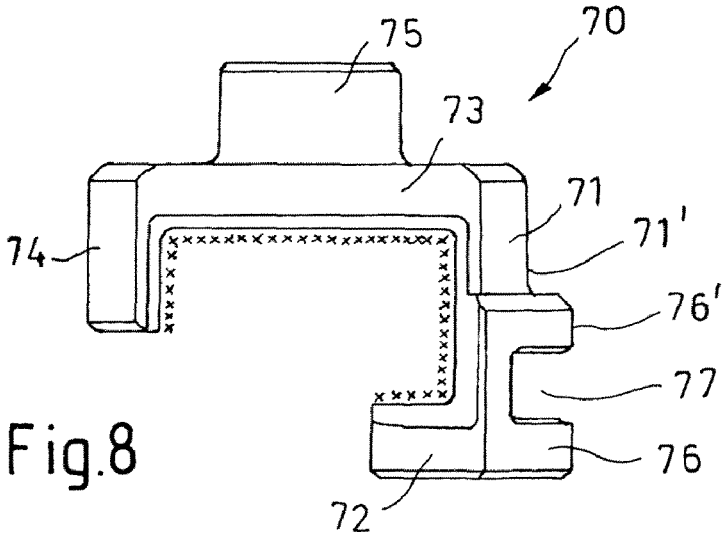
FIG. 8 shows a side view of the wear insert from FIG. 7.
Figure 9:
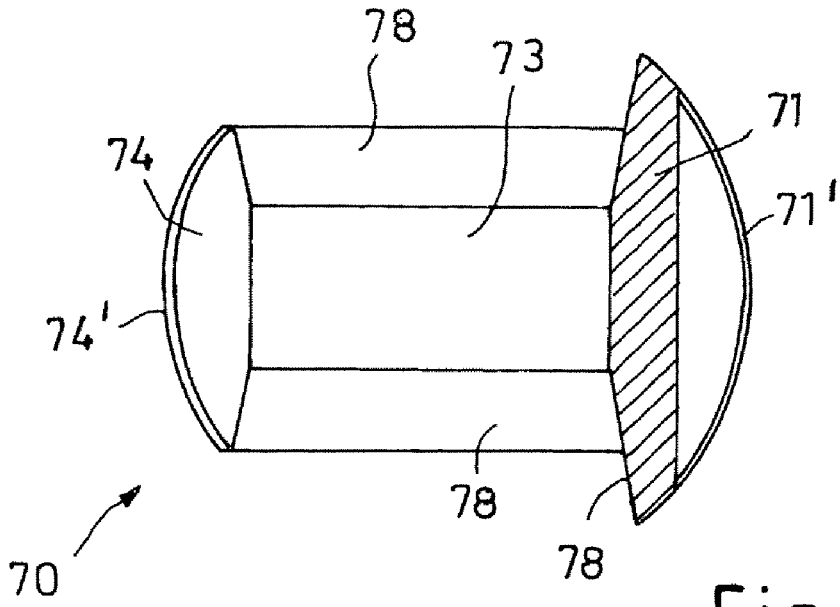
FIG. 9 shows a partially open view of the underside of the wear insert according to FIG. 7.

Reference is now made first to FIGS. 7 to 9, in which a wear insert 70, inserted in the case of the exemplary embodiment according to FIGS. 3 to 9, is represented in detail. The limb 73 of the wear insert that is the upper, inner limb when in the mounted position comprises, on its upper, or back, side, the integrally formed-on pivot pin 75, and, at the end that is on the left in FIGS. 7 and 8, graduates, at right angles, into a relatively short outer limb 74, which extends approximately over only half the height of the inner limb 71, which is opposite it. Engagement behind the toothed rack, or rack drive arrangement, is effected by means of the free, outer limb 74. FIGS. 7 and 9, in particular, show clearly that both the outer limb 74 and inner limb 71, both of which, when in the mounted state, are aligned substantially vertically, are curved in a circular arc on their back sides 71' and 74', respectively, in order that the wear inserts 70 can rotate about the pivot axis in the associated receivers in the guide shoes. At the lower end of inner limb 71, there is a further outer limb 72, again projecting perpendicularly relative thereto, which constitutes the guide projection engaging under the rack drive arrangement. Since, when in the mounted state, the entire, approximately J-shaped inner surface of the wear insert 70, or the inner surface of the respective limbs 71, 72, 73, 74, slide along the outer surfaces of the toothed racks, the inner surfaces are hardened, the hardening being indicated in FIG. 8 by the xx-hatching. The hardening can consist, in particular, of a flame-hardening. Formed onto the back side 71' of the longer inner limb 71 there is a widening annular portion 76, the back side 76' of which, in turn, is curved in a circular arc, and which is provided with a longitudinal groove 77 in which, in the mounted state, there engages a securing means, for the purpose of movably locking the wear insert 70 in the associated receiver in the guide shoe. In order to improve the running behavior, or interaction, between the wear inserts 70 and the outer surfaces of the rack drive arrangement, all limbs 71, 72, 73, 74 are each preferably provided, in the edge region, with a bevel that extends over the length, or height, of the limbs, and that is thus foremost in the direction of motion, these bevels 78 being each offset by approximately 10° relative to the inner surfaces of the limbs 71, 72, 73, 74.

The wear inserts 70 constituting replacement or spare parts are preferably insertable in the receivers 65 beneath both transverse webs 56, such that they can be removed downwards and mounted from below. The bearing receivers 67 for the pivot pins on the wear inserts preferably extend through the transverse webs 56, as can be seen particularly clearly from FIGS. 5 and 6. In the region of both receivers 65, the surfaces of the base wall 51 and of the opposing wall 53 that face towards the receivers 65 are each provided with trough-shaped hollows 68 and 69, respectively, again in the form of a circular arc, which act in combination with the outer surfaces (71', 74', 76'), curved in a circular arc, of the limbs of the wear inserts. The hollows 68, 69 are realized to be concentric around the mid-point of the bearing receivers 67, and therefore concentric relative to the pivot axes 66. To enable the wear inserts to be secured in the receivers 65 by means of the securing means 90 shown in FIGS. 4 and 5, the base wall 51, as shown, in particular, by FIG. 6, has a recess 80, which is assigned to each receiver 65 and which extends as far as the hollow 69. On both sides of the recess 80, a threaded hole 81 is provided, respectively, in a partial portion of the base wall 51, in order to hold the securing means 90, constituted by retaining tabs 91 in the exemplary embodiment of FIGS. 3 to 9, in the locking position by means of two fastening screws 92. For this purpose, each retaining tab 91 comprises a relatively long locking tongue 93, as well as two passage holes 94, through which, in the mounted state, there engage the bolts of the fastening screws 92. The front side of the locking tongue 93 preferably has bevels 95, again on both sides, in order to delimit the swivel play for the wear inserts 70 in the receivers 65. A further delimitation of the motional play for the wear inserts 70 is achieved by means of pivot limiting strips 85, which are welded to the undersides of the transverse webs 56, next to both receivers 65, and which, on the side facing towards the receivers 65, or towards the inserted wear inserts, are provided with wedge surfaces 86 that diverge from one another in a wedge shape, each wedge surface 86 being angled by 3°, such that the maximum motional play for each wear insert is substantially limited to 6°.

As already explained above, the mounting and demounting of the wear inserts 70 can be effected in that a rack drive bar, or toothed rack, is removed and the wear inserts 70 are then removed downwards from the guide shoes 50, without the need for the latter to be detached from the drive assembly (10, FIG. 1). For the purpose of demounting, it suffices to undo the fastening screws 92 that engage in the base wall 51 of the guide shoes 50 and that are always easily accessible, from the demounting side, beneath the shearer loader body. Following undoing of the fastening screws 92, the locking tongues 93 of the retaining pieces 91 can be removed from the recesses 80, it being possible for this removal to be supported, for example, by undoing of the middle screw 96 and the application of a demounting tool or a compressed-air hose. After the locking tongues 93 have become disengaged from the longitudinal groove 77 in the wear inserts 70, the wear inserts 70 can be removed downwards from the bearing receivers 65, since the locking tongues 93 constitute the locking elements for the wear inserts 70, in that they engage in the longitudinal groove 77 on the back side of the inner limb 71 of the wear inserts 70. At the same time, securing of the wear inserts 70 by means of the locking tongues 93 engaging in the longitudinal groove 77 ensures good pivoting mobility of the wear inserts 70 in the guide shoes 50.

Figure 10:
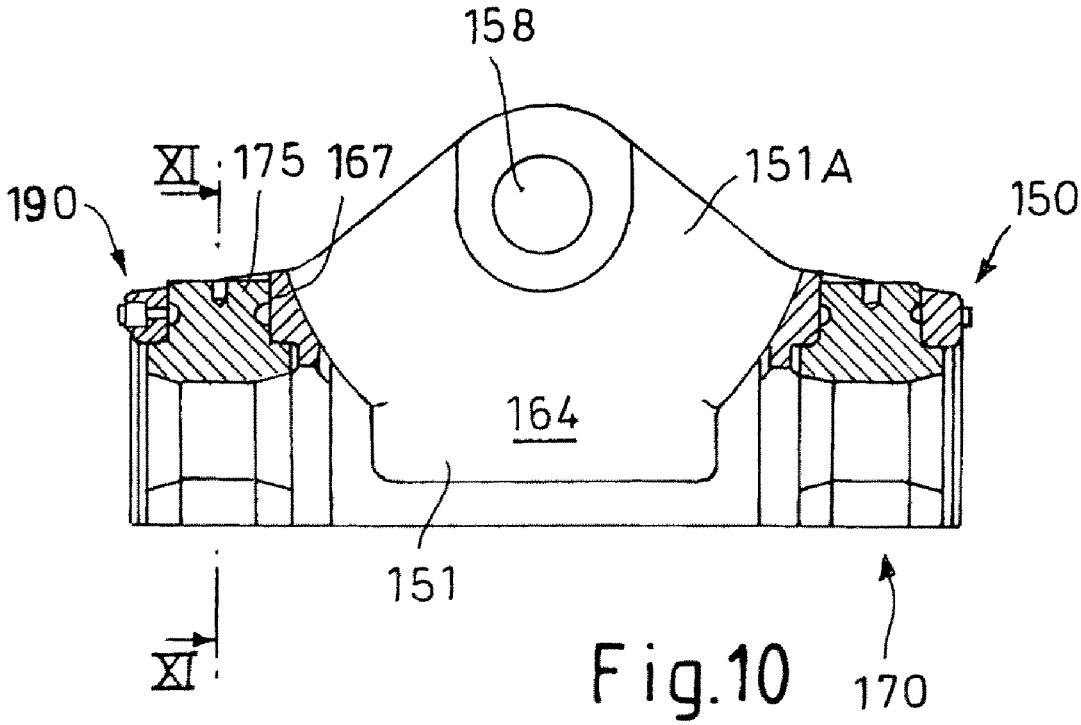
FIG. 10 shows a guide shoe according to a second exemplary embodiment, in a horizontal section through both bearing receivers for the pivot pins.

FIGS. 10 to 12 show an alternative exemplary embodiment for a guide shoe 150 comprising a wear insert 170. Here, likewise, the guide shoe 150 again has a robust base wall 151 and a thinner opposing wall 153, which, respectively, next to a central opening 164 for the through-engagement of the driving toothed wheel and engagement of the teeth of the driving toothed wheel in a rack drive arrangement, are connected by means of transverse webs 156. Respectively realized beneath the transverse webs 156 are the two receivers 165 for the wear inserts 170, which are spaced apart from one another and movably arranged in the receivers 165, and, for the purpose of accommodating with pivoting mobility, both transverse webs 156 are provided with bearing receivers 167 for robust pivot pins 175 on the wear inserts. In contrast to the previous exemplary embodiment, however, in the case of the wear inserts 170 the securing of the wear inserts 170 in the receivers 165 is effected by means of securing means 190 that act directly in combination with the pivot pin 175. As can be seen clearly from FIG. 12, the pivot pin 175 is provided with a circumferential groove 179, in which there engage, for example, clip limbs 191 of a securing clip, as securing means 190, which can be mounted from the transverse sides of the guide shoe 150. The two limbs 191 can also be constituted by the bolt shanks of suitable fastening screws, which, for this purpose, are screwed-in deeply from the transverse sides such that, by means of their shanks, they engage substantially in a positive manner in the circumferential groove 179 on the pivot pin 175, allowing a sufficient motional play. The two outer limbs 172 and 174, as well as the upper inner limb 173, of the wear insert can be realized as in the case of the previous exemplary embodiment and, when in the mounted state, the short outer limb 172 engages under a rack drive arrangement, while the other outer limb 174 engages behind a rack drive arrangement. However, since the securing means do not act in combination with vertical limb 171 opposite the limb 174 that engages behind, this vertical limb can extend, with a constant cross-section, between the inner limb 173 and the limb 172 projecting at right angles thereto, the two opposing limbs 171 and 174 again being curved in a circular arc on their back sides in order to allow swiveling. The guide shoe 150, likewise, has, both in the region of the base wall 151 and in the region of the opposing wall 153, a limb portion 151A and 153A, respectively, which limb portions project up over the transverse sides 156 and in which there are realized passage openings 158, to enable the guide shoe to be fastened to the drive assembly by means of a single bearing bolt.

The third exemplary embodiment of a guide shoe 250, shown in FIG. 13, comprising two movable, replaceable wear inserts 270 that are spaced apart from one another, differs from the exemplary embodiment in FIGS. 10 to 12 primarily in the manner of securing the wear inserts 270 in the receivers 265. In the case of the guide shoe 250, although the securing means 290 does again act in combination with the pivot pin 275, in this case, however, the securing means is constituted by a disc 291, which is detachably connected to the pivot pin 275 by means of a fastening screw 292 and located above the pivot pin. The securing disc 291 has a greater diameter than the pivot pin 275, and the transverse web 256 is provided with a step-shaped bearing receiver 267, such that the discs 291 can bear on the circumferential collar of the step and can thus secure the wear insert 270 in the receiver 265 while, at the same time, ensuring that the wear insert is able to pivot.

In the case of the fourth exemplary embodiment of a guide shoe 350 according to FIG. 14, the wear inserts 370 again have pivot pins 375, which engage in bearing receivers 367, assigned to the receivers 365, in the transverse webs 356. The securing of the wear inserts 370 is effected by means of a securing means 390, which is constituted by L-shaped securing plates or strips, the longer limb 393 of which is screwed in appropriate manner to the base wall 351, while the shorter limb 394 projecting at right angles thereto projects, when in the mounted state, into the receiver 365 for the wear insert 370, and thereby engages under an edge strip 377 realized on the back side of the limb 371 of the wear strip 370 that faces towards the base wall 351. The underside of the shorter limb 394 closes in a substantially flush manner with the underside of the limb 372, which, when in the mounted state, or when applied in operation, engages below the rack drive. The L-shaped securing plates can again be detached from the working-face side, the longer limb 393 of the securing plate 390, which projects vertically upwards when in the mounted state, facing towards the working-face side.

In the case of a fifth exemplary embodiment of a guide shoe 450 according to FIG. 15, the securing of the wear inserts 470, which are pivotably accommodated in the guide shoes 450, is again effected by means of securing means 490 that can be anchored in the base wall 451. As in the case of the previous exemplary embodiment, the wear insert 470 has, on the back side of the vertically extending inner limb 471, an edge strip 477 that engages in an approximately U-shaped securing plate 493, which is mounted between the base wall 451 and the back wall of the limb 471 and held in position by means of a threaded bush 492 that engages through the base wall 451. Removal of the bush 492 enables the securing plate to be removed downwards, together with the wear insert 470, from the receiver 465 in the guide shoe 450. In the case of the guide shoe 450, likewise, the wear insert 470, by means of a pivot pin 475 that engages in a bearing receiver 465, is accommodated in the guide shoe 450 such that it is replaceable and capable of swiveling.

Figure 16:
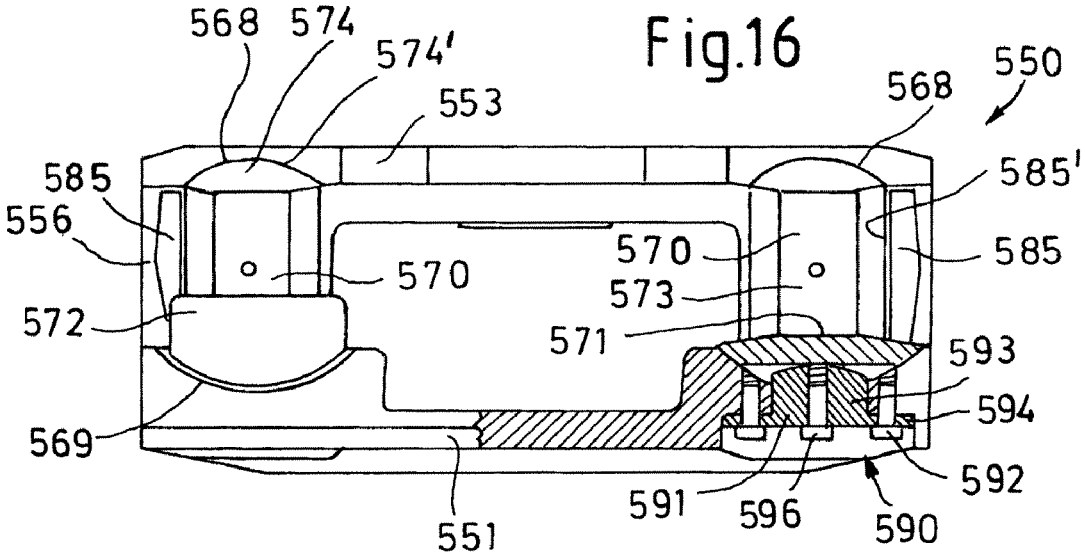
FIG. 16 shows a guide shoe according to the invention, with two built-in wear inserts, similar to FIG. 4, but wherein the pivoting mobility is blocked by means of clamping strips.
Figure 17:
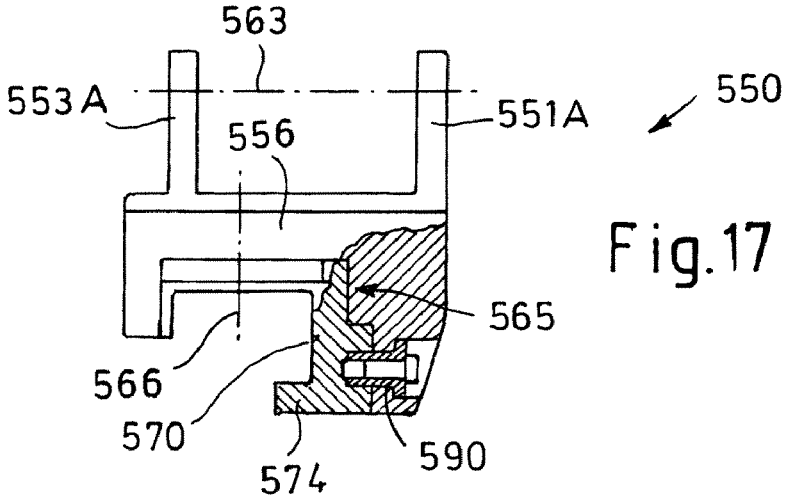
FIG. 17 shows a partially open side view of the transverse side of the guide shoe according to FIG. 16.
Figure 18:
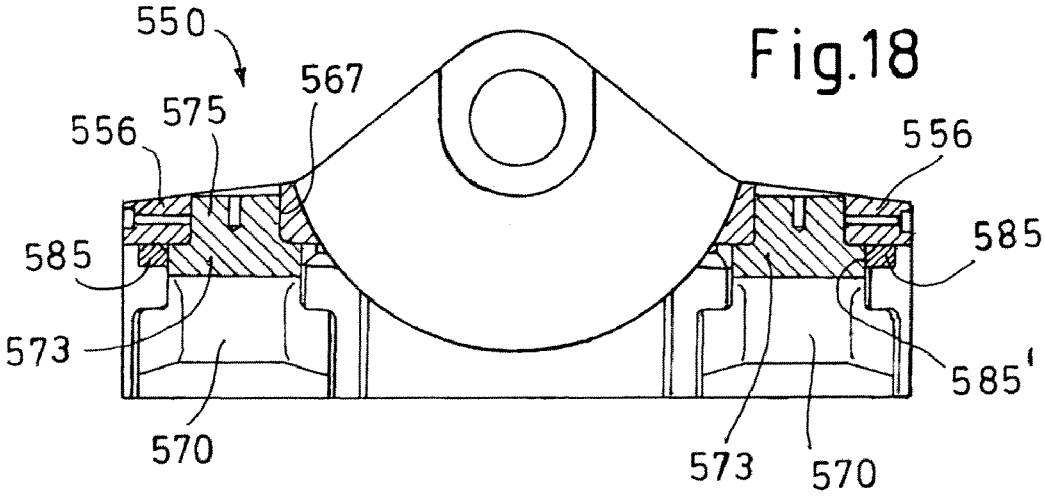
FIG. 18 shows a partially open side view of the longitudinal side of the guide shoe according to FIG. 16.

FIGS. 16 to 18 show a sixth exemplary embodiment of a guide shoe 550 comprising replaceable wear inserts 570 that initially are accommodated so as to be movable, but the pivoting mobility of the wear inserts being inhibited for certain application purposes. The guide shoe 550 has a relatively robustly realized base wall 551 and an opposing wall 553, which is opposite the latter, the base wall 551 and the opposing wall 553 being rigidly connected to one another via robust transverse webs 556. Both the base wall 551 and the opposing wall 553 comprise a wall portion 551A and 553A, respectively, which projects upwards, as a bearing limb, over the transverse webs 556 and has passage openings, not represented here, through which a bolt, for supporting the guide shoe 550 on the shearer-loader drive assembly, can be extended in such a way that the guide shoe can tilt about the bolt axis 563. Realized on both lateral edges of the guide shoe 550, between the inner surfaces of the base wall 551, the transverse webs 556 and the opposing wall 553, there are receivers 565, in which the wear inserts 570 are accommodated. In the operating state, i.e., in particular, during movements of the shearer loader, only the inner surfaces of the limbs 571, 572, 573, 574 come into contact with the toothed racks of the rack drive arrangement. As in the case of the exemplary embodiment according to FIGS. 3 to 9, the individual limbs 571, 572, 573 and 574 are each at right angles to one another, and the one outer limb 572 constitutes a guide projection that engages under the rack drive, while the other outer limb 574, by means of its inside, constitutes a guide surface that engages behind the toothed racks of the rack drive arrangement.

The wear inserts 570 have pivot pins 575 that are realized, as integral component parts, on the back side of the, in the mounted position, upper inner limb 573 of the wear inserts 570, and which engage in bearing receivers 567 in the transverse webs 556. The wear inserts 570 constituting replacement or spare parts are insertable in the receivers 565 beneath both transverse webs 556, such that they can be removed downwards and mounted from below. The bearing receivers 567 for the pivot pins on the wear inserts 570 extend through the transverse webs 556, as can be seen particularly clearly from FIG. 18. The surfaces of the base wall 551 and of the opposing wall 553 that, respectively, face towards the receivers 565 are provided with trough-shaped hollows 568 and 569, respectively, in the form of a circular arc, which act in combination with the outer surfaces 572', 574', curved in a circular arc, of the limbs of the wear inserts. The wear inserts are secured in the receivers 565 by means of the securing means 590, shown in FIG. 16, which have the same structure as in the case of the exemplary embodiment according to FIGS. 3 to 9, for which reason reference is made, suplementally, to the statements there concerning the functioning of the retaining tab 591, the locking tongue 593, the passage holes 594 and the fastening screws 592, 594. In the exemplary embodiment according to FIGS. 16 to 18, the wear inserts 570 are not pivotable, since clamping strips 585 are welded to the undersides of the transverse webs 556, next to both receivers 565, which clamping strips bear positively, by means of a straight back side 585', on the outer edge of the limbs 573 of the wear inserts 570, for which reason the wear inserts cannot move or, at most, can move minimally. The clamping strips can have the same structure as the pivot limiting strips in FIG. 6 and, only rotated by 180°, be welded to the transverse webs. The pivoting mobility could also be inhibited directly by means of the securing means, in that the latter bear positively on the wear inserts.

For one skilled in the art, there ensue from the preceding description numerous modifications and variations, which are intended to come within the scope of protection of the annexed claims. Shown in all exemplary embodiments are guide shoes that have a limb portion, which projects out over the base wall and the opposing wall, and in which there are realized passage holes for a bearing bolt for the guide shoe. Such guide shoes constitute the preferred field of application of the invention. The concept, according to the invention, of wear inserts that are movable, or can be swiveled, and that constitute the sole guide surface between the guide shoes and the rack drive arrangements, can nevertheless be used in the case of all known designs of shearer loader systems. Thus, the guide surface and the guide projection could also be realized in a common limb and be offset substantially only in a V shape in relation to one another, provided that it is ensured at the same time that they are movably restrained, as replaceable wear inserts, on the guide shoe. Finally, other fastening possibilities and securing possibilities, as well as bearing possibilities for pivotable accommodation of wear inserts in guide shoes, are also obvious to one skilled in the art. Under certain operating conditions, it can be advantageous not to allow the pivoting mobility of the wear inserts. The scope of protection of the claims is also intended to include developments and uses of the guide shoes, or wear inserts, according to the invention, in which the pivoting mobility of the wear inserts is inhibited, in particular, temporarily, e.g. through locking the wear inserts by means of correspondingly realized securing means, by means of inserts or through fastening intermediate pieces between the pivot limiting strips and the wear inserts, replacing the pivot limiting strips with clamping strips that prevent swiveling, or the like. The advantage of the ease of replacing the wear inserts is retained, and replaceable, non-pivotable wear inserts, having the described structure and the described further design features, are of intrinsic inventive significance.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A guide shoe for a shearer loader, comprising at least one base wall, comprising a guide projection, on the base-wall side, for engaging under a rack drive of a rack drive arrangement, and comprising a guide surface for engaging behind the rack drive, wherein the guide projection and the guide surface are realized on wear inserts that are movable relative to the guide shoe and replaceably fastened to the guide shoe.

2. The guide shoe as claimed in claim 1, wherein an opposing wall, which is opposite and connected to the at least one base wall, and on the side of which the guide surface is realized, there being passage openings in the at least one base wall and in the opposing wall for the engagement and passage of a bearing bolt, for the purpose of pivotably mounting and supporting the guide shoe on the assembly.

3. The guide shoe as claimed in claim 1, wherein the wear inserts are accommodated in receivers in the guide shoe such that they can be removed downwards.

4. The guide shoe as claimed in claim 1, wherein each guide shoe includes two wear inserts.

5. The guide shoe as claimed in claim 2, wherein the wear inserts are accommodated in receivers in the guide shoe such that they can be removed downwards and wherein the wear inserts that are inserted in the receivers are pivotable about a pivot axis, the pivot axis being aligned perpendicularly relative to the axis of the bearing bolt.

6. The guide shoe as claimed in claim 5 wherein the receivers are realized on both sides of the passage openings.

7. The guide shoe as claimed in claim 2 wherein the wear inserts have a back side and are provided on the back side, with a pivot pin being insertable in a bearing receiver in the guide shoe.

8. The guide shoe as claimed in claim 7, wherein the base wall and the opposing wall are connected to one another via two transverse webs that are spaced apart from one another, each transverse web having a bearing receiver for the pivot pin of a wear insert.

9. The guide shoe as claimed in claim 1, wherein each wear insert has four limbs arranged at right angles to one another, the four limbs including a first outer limb which constitutes the guide projection and a second outer limb which constitutes the guide surface.

10. The guide shoe as claimed in claim 9, wherein a back wall of one of the four limbs on a base-wall side and a back side of one of the four limbs on an opposing-wall side are curved in a circular arc.

11. The guide shoe as claimed in claim 10 wherein the four limbs of the wear insert are provided with bevels at their edges.

12. The guide shoe as claimed in claim 9 wherein the four limbs of the wear insert are provided with bevels at their edges.

13. The guide shoe as claimed in claim 5, wherein the receivers for the wear inserts comprise a trough-shaped recess in the base wall and a trough-shaped recess in the opposing wall, which recesses are concentric relative to the pivot axis.

14. The guide shoe as claimed in claim 1, wherein pivot limiting means, which delimit the maximum pivoting movement of the wear inserts are on the wear inserts.

15. The guide shoe as claimed in claim 1, wherein each wear insert is replaceably fastened in the receiver by a securing means.

16. The guide shoe as claimed in claim 1, wherein the mobility of the wear inserts temporarily undergoes inhibition, or is inhibited.

17. The guide shoe as claimed in claim 16, wherein arrestment of the wear inserts is effected through locking by at least one of a securing means, inserts, and intermediate pieces.

18. A guide shoe for a shearer loader comprising at least one base wall, comprising a guide projection, on the base wall side, for engaging under a rack drive of a rack drive arrangement, and comprising a guide surface for engaging behind the rack drive, wherein the guide projection and the guide surface are on wear inserts that are immovably and replaceably fastenable, to the guide shoe and wherein the wear inserts are accommodated in receivers in the guide shoe such that they can be removed downwards.

19. The guide shoe as claimed in claim 18, wherein an opposing wall, which is opposite and connected to the at least one base wall, and on the side of which the guide surface is realized, there being passage openings in the at least one base wall and in the opposing wall for the engagement and passage of a bearing bolt, for the purpose of pivotably mounting and supporting the guide shoe on the assembly.

20. The guide shoe as claimed in claim 18, wherein each guide shoe accommodates or comprises two wear inserts.

21. The guide shoe as claimed in claim 18, wherein the receivers are realized on both sides of the passage openings.

22. The guide shoe as claimed in claim 19, wherein the receivers for the wear inserts comprise a trough-shaped hollow in the base wall and a trough-shaped hollow in the opposing wall, which hollows are concentric relative to the pivot axis.

23. The guide shoe as claimed in claim 18, wherein each wear insert is replaceably fastened in the receiver by means of a securing means.

24. The guide shoe as claimed in claim 16, wherein, for the purpose of inhibiting the mobility, clamping strips are arranged in both receivers.

25. The guide shoe as claimed in claim 24, wherein the clamping strips are detachably screwed onto the underside of the transverse webs.

* * * * *